US008215400B2

(12) United States Patent
Roane et al.

(10) Patent No.: US 8,215,400 B2
(45) Date of Patent: Jul. 10, 2012

(54) SYSTEM AND METHOD FOR OPENING A WINDOW IN A CASING STRING FOR MULTILATERAL WELLBORE CONSTRUCTION

(75) Inventors: Thomas Owen Roane, Alvord, TX (US); Stuart Alexander Telfer, Stonehaven (GB)

(73) Assignee: Halliburton Energy Services, Inc., Houston, TX (US)

( * ) Notice: Subject to any disclaimer, the term of this patent is extended or adjusted under 35 U.S.C. 154(b) by 82 days.

(21) Appl. No.: 12/915,350

(22) Filed: Oct. 29, 2010

(65) Prior Publication Data

US 2012/0103612 A1 May 3, 2012

(51) Int. Cl.
*E21B 29/06* (2006.01)

(52) U.S. Cl. ..... 166/313; 166/242.7; 175/97; 175/321

(58) Field of Classification Search ..... 166/50, 166/117.5, 117.6, 242.7, 313; 175/51, 77–83, 175/92, 94, 97–100, 106, 296, 297, 300, 175/305, 315, 321
See application file for complete search history.

(56) References Cited

U.S. PATENT DOCUMENTS

| | | | | | |
|---|---|---|---|---|---|
| 2,544,473 | A * | 3/1951 | Smith | 175/296 |
| 2,710,740 | A * | 6/1955 | Dempsey | 175/92 |
| 5,188,191 | A * | 2/1993 | Tomek | 175/321 |
| 5,584,353 | A * | 12/1996 | Chancey et al. | 175/297 |
| 5,730,224 | A | 3/1998 | Williamson et al. | |
| 5,735,350 | A | 4/1998 | Longbottom et al. | |
| 5,829,518 | A | 11/1998 | Gano et al. | |
| 6,039,118 | A * | 3/2000 | Carter et al. | 166/355 |
| 6,041,855 | A | 3/2000 | Nistor | |
| 6,070,670 | A * | 6/2000 | Carter et al. | 166/381 |
| 6,116,344 | A * | 9/2000 | Longbottom et al. | 166/298 |
| 6,286,592 | B1 * | 9/2001 | Moore et al. | 166/50 |
| 6,286,599 | B1 | 9/2001 | Surjaatmadja et al. | |
| 6,474,415 | B1 | 11/2002 | Ohmer | |
| 6,488,090 | B1 | 12/2002 | Ohmer | |
| 6,550,551 | B2 * | 4/2003 | Brunnert et al. | 175/61 |
| 6,668,945 | B2 | 12/2003 | Ohmer | |
| 6,926,102 | B2 * | 8/2005 | Hess et al. | 175/97 |
| 7,703,524 | B2 | 4/2010 | Parlin | |
| 7,726,401 | B2 | 6/2010 | Parlin et al. | |
| 2007/0246227 | A1 * | 10/2007 | Ezell et al. | 166/387 |
| 2009/0314497 | A1 * | 12/2009 | Johnson | 166/381 |

* cited by examiner

*Primary Examiner* — Daniel P Stephenson
*Assistant Examiner* — Blake Michener
(74) *Attorney, Agent, or Firm* — Lawrence R. Youst

(57) ABSTRACT

A system for opening a window in a casing string (42) positioned in a wellbore (32). The system includes a hydraulic pressure intensifier (116) having a housing and a piston assembly with a differential piston area. The piston assembly is longitudinally shiftable relative to the housing and is initially secured relative thereto to prevent longitudinal movement therebetween. An anchor assembly (114) is operable to longitudinally secure the hydraulic pressure intensifier (116) within the casing string (42). A window opening tool (118) operably associated with the hydraulic pressure intensifier (116) is operably engagable with the casing string (42) such that when the anchor assembly (114) is longitudinally secured within the casing string (42) and the piston assembly is unsecured relative to the housing under hydrostatic pressure, longitudinal movement of the piston assembly transmits a force to the window opening tool (118), thereby opening the window in the casing string (42).

22 Claims, 9 Drawing Sheets

28
10
26
12
20
18
22
16
24
30
32
34
48
50
46
36
38
52
42
40
14

SYSTEM AND METHOD FOR OPENING A WINDOW IN A CASING STRING FOR MULTILATERAL WELLBORE CONSTRUCTION

TECHNICAL FIELD OF THE INVENTION

This invention relates, in general, to equipment utilized in conjunction with operations performed in subterranean wells and, in particular, to a system and method for opening a window in a casing string for multilateral wellbore construction.

BACKGROUND OF THE INVENTION

Without limiting the scope of the present invention, its background will be described in relation to forming a window in a casing string for a multilateral well, as an example.

In multilateral wells it is common practice to drill a branch or lateral wellbore extending laterally from an intersection with a main or parent wellbore. Typically, once the casing string is installed and the parent wellbore has been completed, a whipstock is positioned in the casing string at the desired intersection and then a rotating mill is deflected laterally off of the whipstock to form a window through the casing sidewall.

Once the casing window is created, the lateral wellbore can drilled. In certain lateral wellbores, when drilling operation has been completed, a casing string is installed in the lateral branch. Casing the lateral branch may be accomplished with the installation of a liner string that is supported in the main wellbore and extends a desired distance into the lateral wellbore. Typically, once the lateral casing string is installed and the lateral wellbore has been completed, it is desirable to reestablish access to the main wellbore. In this operation, a whipstock is positioned in the casing string at the desired location and then a rotating mill is deflected off of the whipstock to form an access window through the lateral casing sidewall.

It has been found, however, that the milling process used to form the lateral window and the main wellbore access window usually produces a large amount of debris, such as small pieces of the metal casing, which accumulate in the parent wellbore. This debris may make the whipstock difficult to retrieve after the milling process is completed. In addition, even after the whipstock is retrieved, the debris may cause other problems, such as plugging flow control devices, damaging seals, obstructing seal bores, interfering with passage of equipment past the intersection and the like.

Accordingly, a need has arisen for an improved system and method of opening windows in the casing strings during multilateral wellbore construction. In addition, a need has arisen for such an improved system and method that does not require the use of a mill that generates wellbore debris during multilateral wellbore construction.

SUMMARY OF THE INVENTION

The present invention disclosed herein is directed to systems and methods of using a hydraulic pressure intensifier to generate the force required to open a window in a casing string during multilateral wellbore construction. The systems and methods of the present invention do not require the use of a mill to open the window, thereby reducing the wellbore debris generated during multilateral wellbore construction.

In one aspect, the present invention is directed to a system for opening a window in a casing string positioned in a wellbore. The system includes a hydraulic pressure intensifier having a housing and a piston assembly with a differential piston area. The piston assembly is longitudinally shiftable relative to the housing and is initially secured relative to the housing to prevent longitudinal movement therebetween. An anchor assembly is operably associated with the hydraulic pressure intensifier and is operable to longitudinally secure the hydraulic pressure intensifier within the casing string. A window opening tool operably associated with the hydraulic pressure intensifier is operably engagable with the casing string such that when the anchor assembly is longitudinally secured within the casing string and the piston assembly is unsecured relative to the housing under hydrostatic pressure in the wellbore, longitudinal movement of the piston assembly transmits a force to the window opening tool, thereby opening the window in the casing string.

In one embodiment, the casing string through which the window is opened is a main wellbore casing string. In another embodiment, the casing string through which the window is opened is a lateral wellbore casing string. In some embodiments, the piston assembly is initially secured relative to the housing by propping a plurality of lugs extending through openings of the piston assembly in a groove of the housing. In these embodiments, the piston assembly is unsecured relative to the housing by longitudinally shifting a running tool to unprop the plurality of lugs.

In one embodiment, the piston assembly includes a first piston having a first cross sectional area and a second piston operably associate with the first piston and having a second cross sectional area, wherein first cross sectional area is greater than the second cross sectional area. In certain embodiments, the piston assembly includes a dampening assembly operable to control the velocity of the longitudinal movement of the piston assembly. In some embodiments, the dampening assembly is operable to control the rate of hydraulic fluid transfer therethrough. In one embodiment, the anchor assembly may be a latch assembly that is operably engagable with a latch coupling of the casing string. In another embodiment, the window opening tool is selected from the group consisting of a cutting tool, a retrieval tool and a penetration tool.

In another aspect, the present invention is directed to a method for opening a window in a casing string positioned in a wellbore. The method includes running a hydraulic pressure intensifier having a housing and a piston assembly with a differential piston area in the casing string, the piston assembly initially secured relative to the housing to prevent longitudinal movement therebetween, positioning a window opening tool operably associated with the hydraulic pressure intensifier at a target location in the casing string, longitudinally securing the hydraulic pressure intensifier within the casing string with an anchor assembly, unsecuring the piston assembly relative to the housing under hydrostatic pressure in the wellbore and longitudinally moving the piston assembly to transmit a force to the window opening tool, thereby opening the window in the casing string.

The method may also include running the hydraulic pressure intensifier into a main wellbore casing string, running the hydraulic pressure intensifier into a lateral wellbore casing string, radially propping a plurality of lugs extending through openings of the piston assembly in a groove of the housing to initially secure the piston assembly relative to the housing, longitudinally shifting a running tool to unprop the plurality of lugs, controlling the velocity of the longitudinal movement of the piston assembly with a dampening assembly of the piston assembly, controlling the rate of hydraulic fluid transfer through the damping assembly, engaging a latch assembly with a latch coupling of the casing string, cutting the window in the casing string, removing a window insert from the casing string or penetrating the casing string to open a pre-cut window in the casing string.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
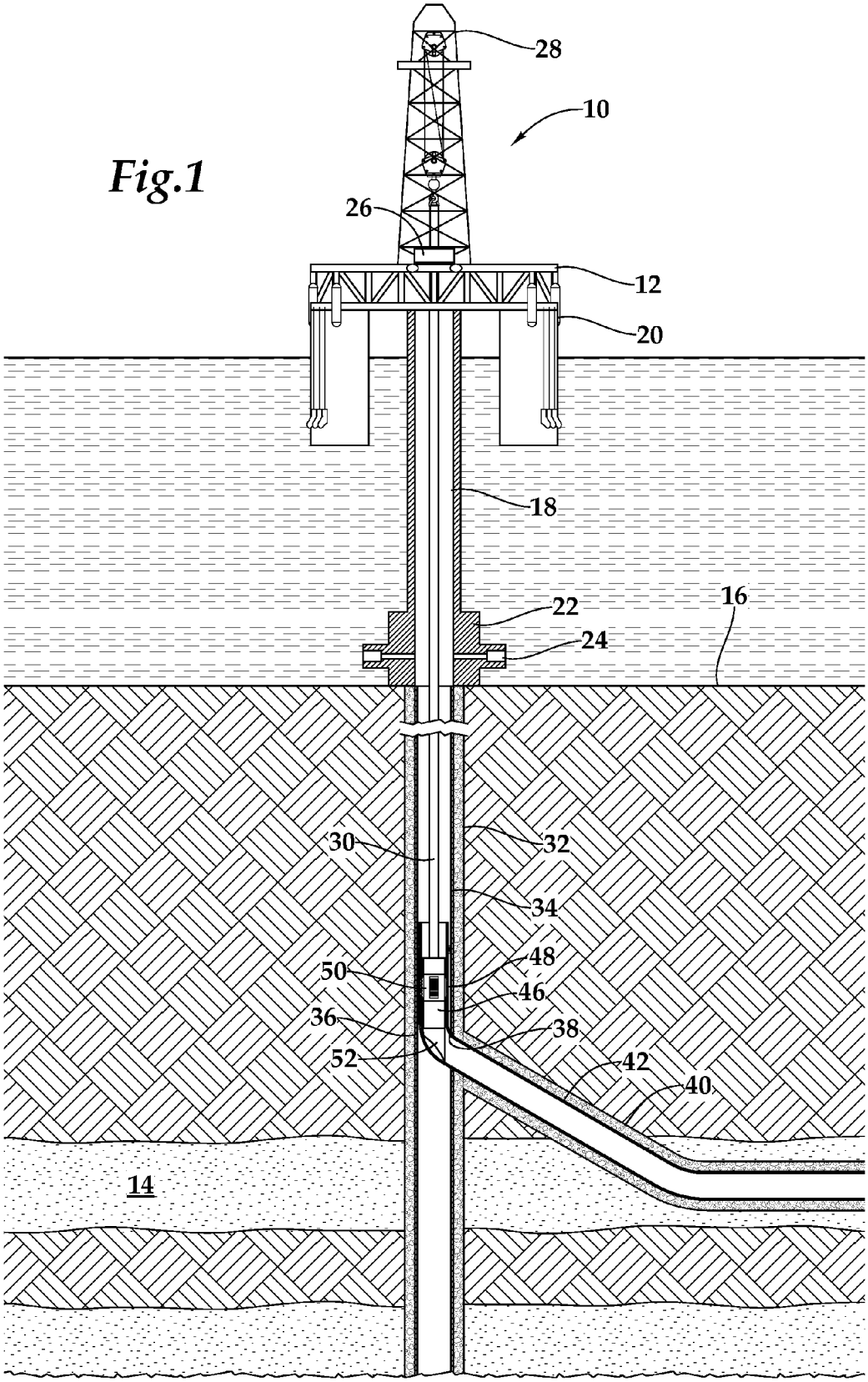
FIG. 1 is a schematic illustration of an offshore platform operating a hydraulic pressure intensifier operable to open a window in a casing string during multilateral wellbore construction according to an embodiment of the present invention.

Referring to FIG. 1, a hydraulic pressure intensifier operable to open a window in a casing string during multilateral wellbore construction in use with an offshore oil and gas platform is schematically illustrated and generally designated 10. A semi-submersible platform is centered over submerged oil and gas formation 14 located below sea floor 16. A subsea conduit 18 extends from deck 20 of platform 12 to wellhead installation 22, including blowout preventers 24. Platform 12 has a hoisting apparatus 26 and a derrick 28 for raising and lowering pipe strings such as drill string 30. A main wellbore 32 has been drilled through the various earth strata including formation 14. The terms "parent" and "main" wellbore are used herein to designate a wellbore from which another wellbore is drilled. It is to be noted, however, that a parent or main wellbore does not necessarily extend directly to the earth's surface, but could instead be a branch of yet another wellbore. A casing string 34 is cemented within main wellbore 32. The term "casing" is used herein to designate a tubular string used to line a wellbore. Casing may actually be of the type known to those skilled in the art as "liner" and may be made of any material, such as steel or composite material and may be segmented or continuous, such as coiled tubing.

The casing string 34 includes a window joint 36 interconnected therein through which a window 38 has been opened. As illustrated, a branch or lateral wellbore 40 has been drilled through window 38 from main wellbore 32. The terms "branch" and "lateral" wellbore are used herein to designate a wellbore which is drilled outwardly from its intersection with another wellbore, such as a parent or main wellbore. A branch or lateral wellbore may have another branch or lateral wellbore drilled outwardly therefrom. A casing string 42 in the form of a liner has been installed in lateral wellbore 40. The upper portion of liner string 42 is supported within casing string 34 in main wellbore 32.

To gain access to main wellbore 32 below the illustrated multilateral junction, an access window must be formed through liner string 42. As explained in greater detail below, a hydraulic pressure intensifier 46 is secured in liner string 42 by an anchor assembly depicted as a latch coupling 48 that is operably engaged with a latch assembly 50 interconnected within liner string 42. Thereafter, operation of hydraulic pressure intensifier 46 causes window opening tool 52 for form a window in liner string 42.

Even though FIG. 1 depicts the present invention in a vertical section of the main wellbore, it should be understood by those skilled in the art that the system of the present invention is equally well suited for use in wellbores having other directional configurations including horizontal wellbores, deviated wellbores, slanted wells, lateral wells and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Also, even though FIG. 1 depicts the present invention forming a window in a lateral wellbore liner string, it should be understood by those skilled in the art that the present invention is equally well suited for use in forming a window in the main wellbore casing string.

Figure 2:
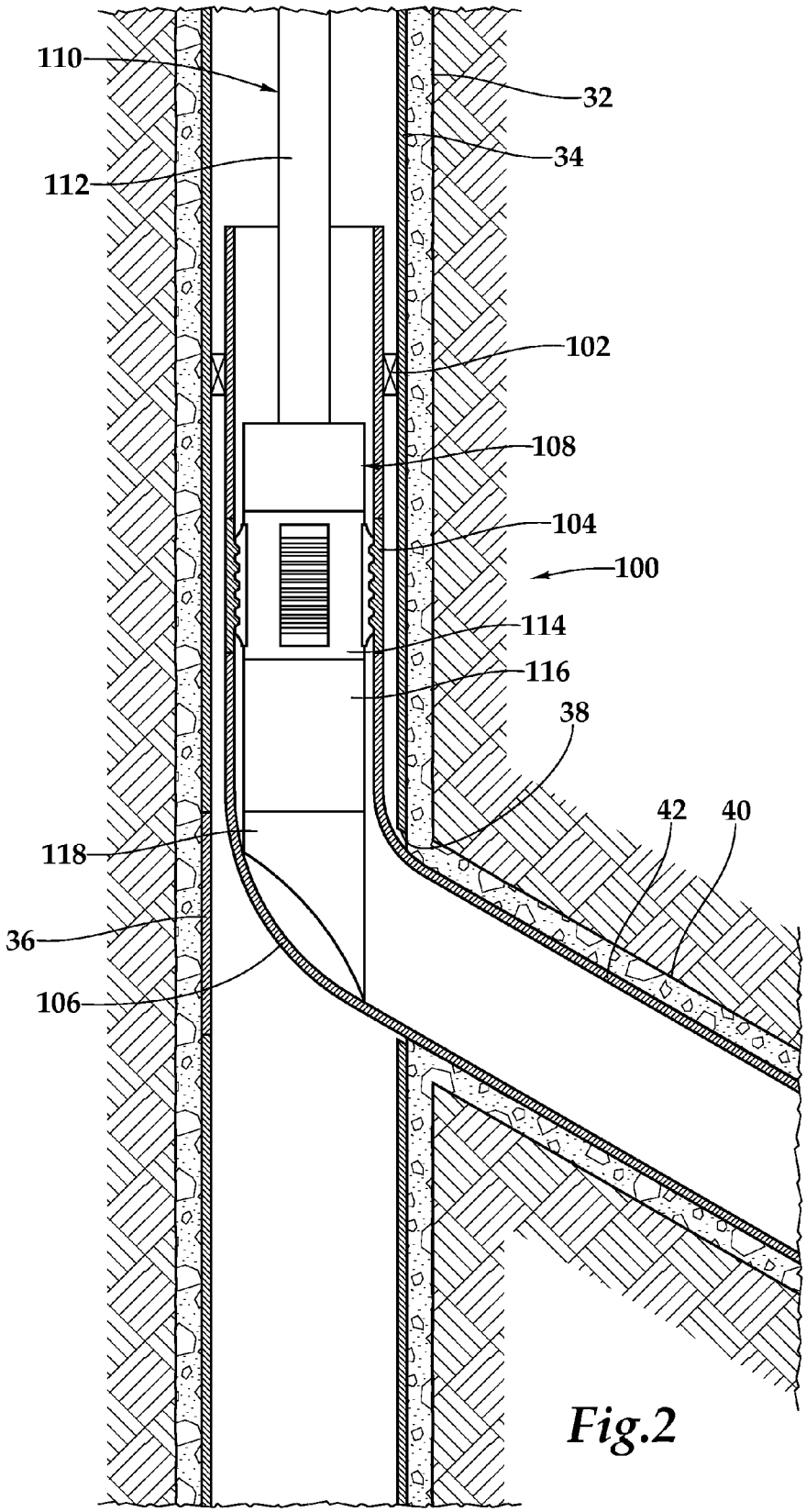
FIG. 2 is a schematic illustration of a hydraulic pressure intensifier operable to open a window in a casing string during multilateral wellbore construction according to an embodiment of the present invention.

Referring now to FIG. 2, a system for opening a window in a casing string during multilateral wellbore construction of the present invention is schematically depicted and generally designated 100. In the illustrated embodiment, main wellbore 32 and lateral wellbore 40 have been drilled. Main wellbore 32 has a casing string 34 cemented therein. Casing string 34 includes a window joint interconnected therein through which a window 38 has been opened. Lateral wellbore 40 has a casing string 42 cemented therein. Casing string 42 is in the form of a liner string, the upper portion of which is supported within casing string 34 in main wellbore 32 by liner hanger 102. Interconnected within liner string 42 is a latch coupling 104. As explained in further detail below, latch coupling 104 preferably has a unique profile including a plurality preferential circumferential alignment elements that is operable to receive a latch assembly therein and locate the latch assembly in a particular circumferential orientation. Also interconnected within liner string 42 is a window joint 106 through which an access window can be formed.

In the illustrated embodiment, a tool string 108 has been run in liner string 42 on a conveyance 110 such as a drill string 112. Tool string 108, includes a latch assembly 114, a hydraulic pressure intensifier 116 and a window opening tool depicted as a cutting tool 118. Preferably, latch assembly 114 has a unique outer profile that is operable to engage with the unique inner profile and preferential circumferential alignment elements of latch coupling 104. As explained in greater detail below, hydraulic pressure intensifier 116 is operable to provide work downhole in the form of a longitudinal movement with sufficient force to enable a window to be opened through a casing string or other metal tubular. Cutting tool 118 is designed to make a cut through liner string 42 responsive to the axial movement and force generated by hydraulic pressure intensifier 116. Preferably, cutting tool 118 captures the window section that is cut from liner string such that the window section can be retrieved to the surface with tool string 108 leaving an open window 120 in liner string 42, as best seen in FIG. 4.

Figure 3:
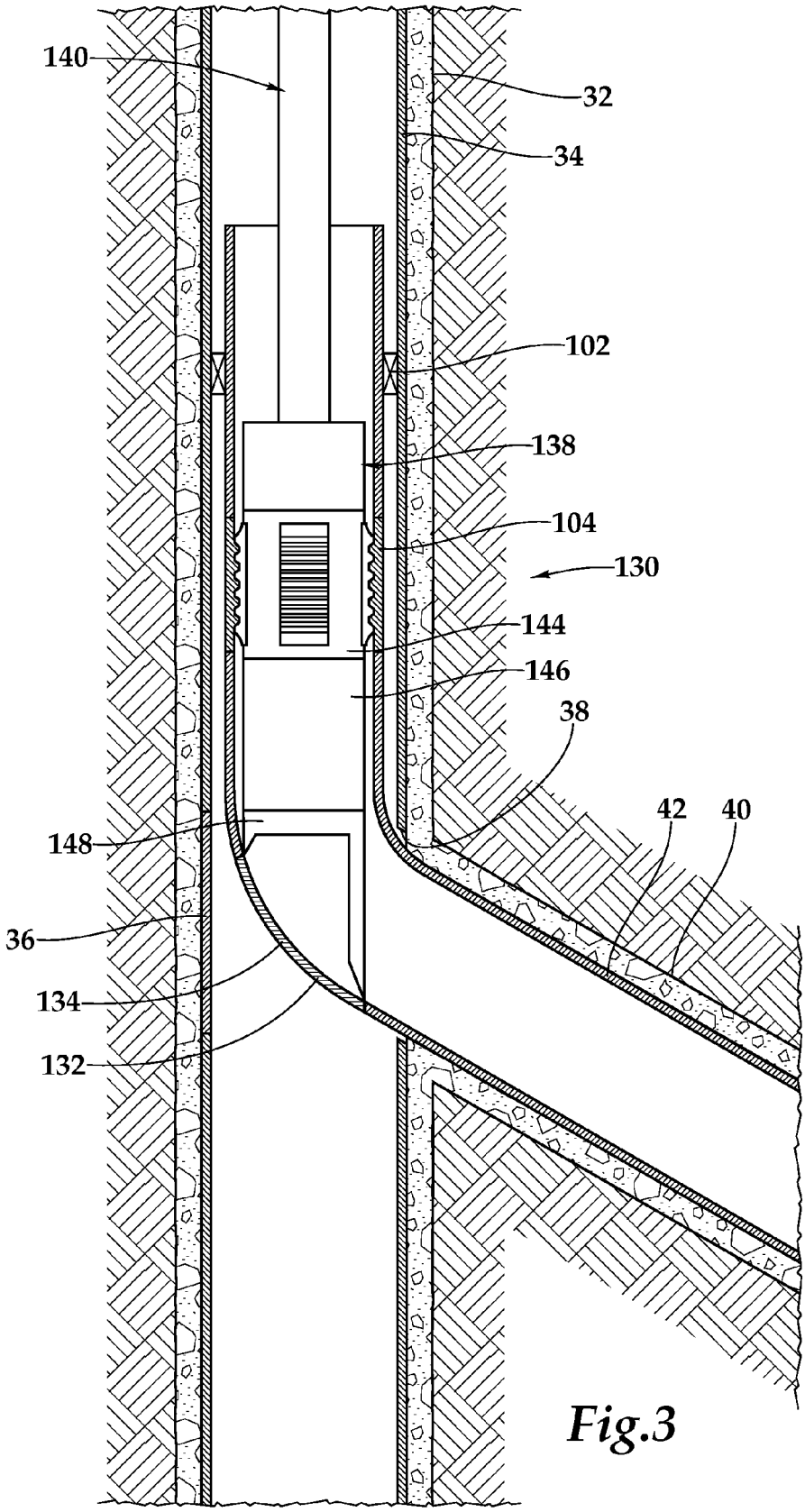
FIG. 3 is a schematic illustration of a hydraulic pressure intensifier operable to open a window in a casing string during multilateral wellbore construction according to an embodiment of the present invention.

Referring now to FIG. 3, a system for opening a window in a casing string during multilateral wellbore construction of the present invention is schematically depicted and generally designated 130. In the illustrated embodiment, main wellbore 32 and lateral wellbore 40 have been drilled. Main wellbore 32 has a casing string 34 cemented therein. Casing string 34 includes a window joint interconnected therein through which a window 38 has been opened. Lateral wellbore 40 has a casing string 42 cemented therein. Casing string 42 is in the form of a liner string, the upper portion of which is supported within casing string 34 in main wellbore 32 by liner hanger 102. Interconnected within liner string 42 is a latch coupling 104 that has a unique profile operable to receive a latch assembly. Also interconnected within liner string 42 is a window joint 132 that includes a pre-milled window having a window insert 134 positioned therein.

In the illustrated embodiment, a tool string 138 has been run in liner string 42 on a conveyance 140. Tool string 138, includes a latch assembly 144, a hydraulic pressure intensifier 146 and a window opening tool depicted as a retrieval tool 148. Preferably, latch assembly 144 has a unique outer profile that is operable to engage with the unique inner profile of latch coupling 104. Hydraulic pressure intensifier 146 is operable to provide work downhole in the form of a longitudinal movement with sufficient force to enable window insert 134 to be released and removed by retrieval tool 148. Retrieval tool 148 is designed to release and remove window insert 134 from window joint 132 responsive to the axial movement and force generated by hydraulic pressure intensifier 146.

Figure 4:
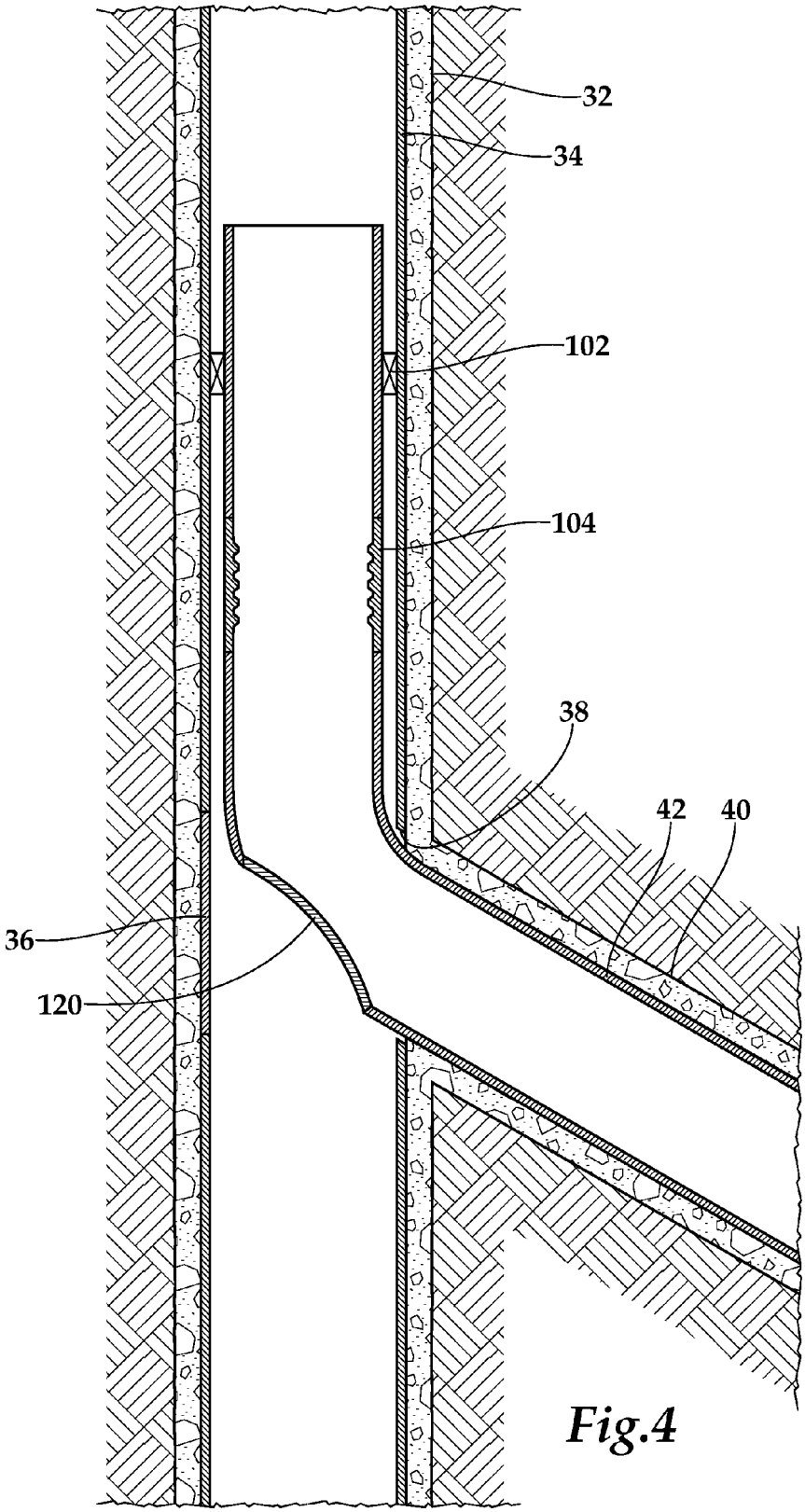
FIG. 4 is a schematic illustration of a multilateral junction formed according to an embodiment of the present invention.

Preferably, retrieval tool 148 captures window insert 134 such that window insert 134 can be retrieved to the surface with tool string 138 leaving an open window 120 in liner string 42, as best seen in FIG. 4.

Figure 5:
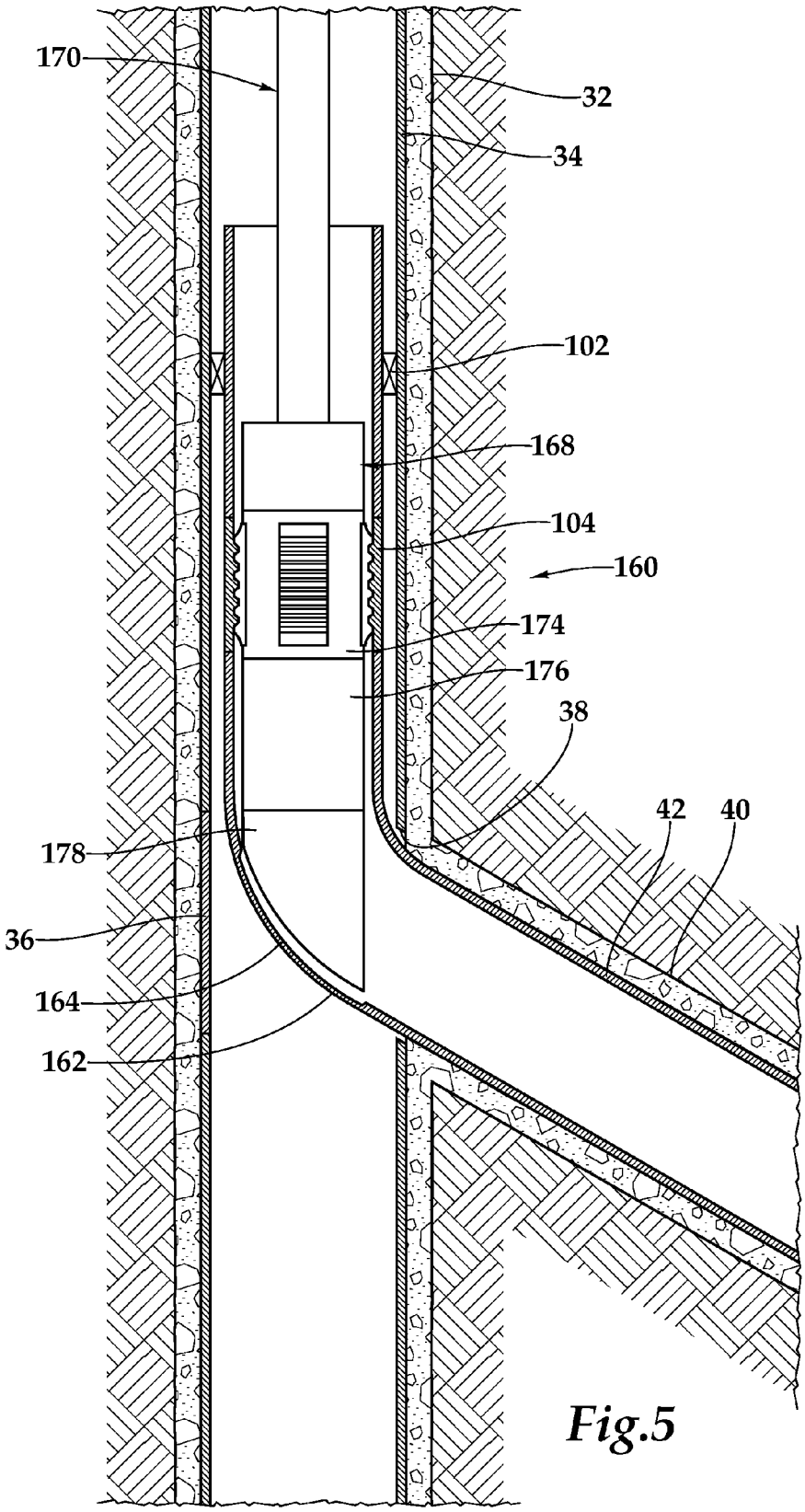
FIG. 5 is a schematic illustration of a hydraulic pressure intensifier operable to open a window in a casing string during multilateral wellbore construction according to an embodiment of the present invention.

Referring now to FIG. 5, a system for opening a window in a casing string during multilateral wellbore construction of the present invention is schematically depicted and generally designated 160. In the illustrated embodiment, main wellbore 32 and lateral wellbore 40 have been drilled. Main wellbore 32 has a casing string 34 cemented therein. Casing string 34 includes a window joint interconnected therein through which a window 38 has been opened. Lateral wellbore 40 has a casing string 42 cemented therein. Casing string 42 is in the form of a liner string, the upper portion of which is supported within casing string 34 in main wellbore 32 by liner hanger 102. Interconnected within liner string 42 is a latch coupling 104 that has a unique profile operable to receive a latch assembly. Also interconnected within liner string 42 is a window joint 162 that includes a window pattern 164 pre-cut therein, for example, by scoring or otherwise preferentially weakening certain areas on the inner or outer surface of window joint 162 such that window joint 162 will open in a predictable manner.

Figure 6:
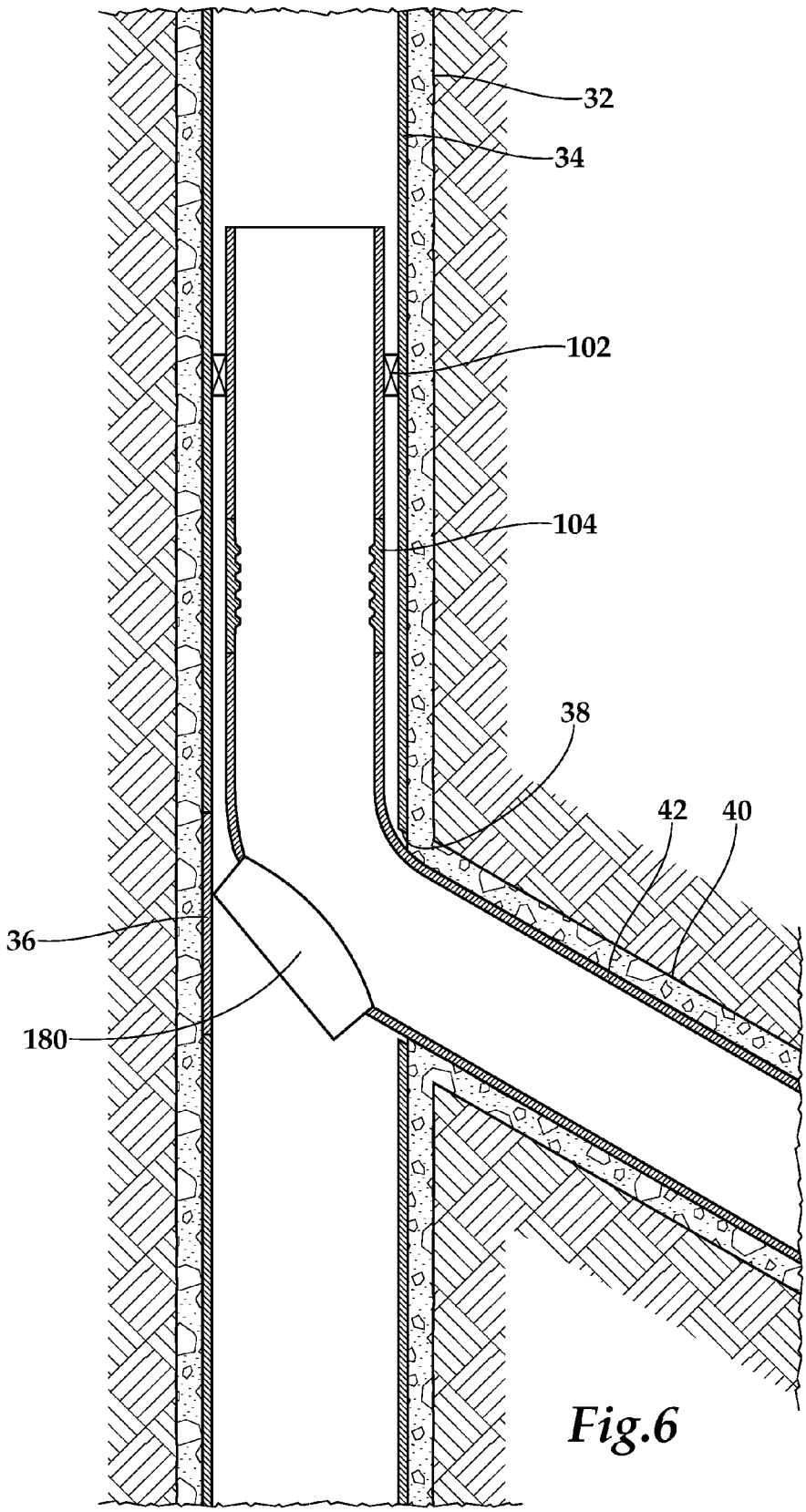
FIG. 6 is a schematic illustration of a multilateral junction formed according to an embodiment of the present invention.

In the illustrated embodiment, a tool string 168 has been run in liner string 42 on a conveyance 170. Tool string 168, includes a latch assembly 174, a hydraulic pressure intensifier 176 and a window opening tool depicted as a penetration tool 178. Preferably, latch assembly 174 has a unique outer profile that is operable to engage with the unique inner profile of latch coupling 104. Hydraulic pressure intensifier 176 is operable to provide work downhole in the form of a longitudinal movement with sufficient force to enable opening of the pre-cut window 164 by penetration tool 178. Penetration tool 178 is designed to open pre-cut window 164 along its score lines without creating debris. For example, the score pattern of pre-cut window 164 may enable the window to be open by folding back two door sections such as in a bomb bay door style, leaving an open window 180 in liner string 42, as best seen in FIG. 6.

Figure 7:
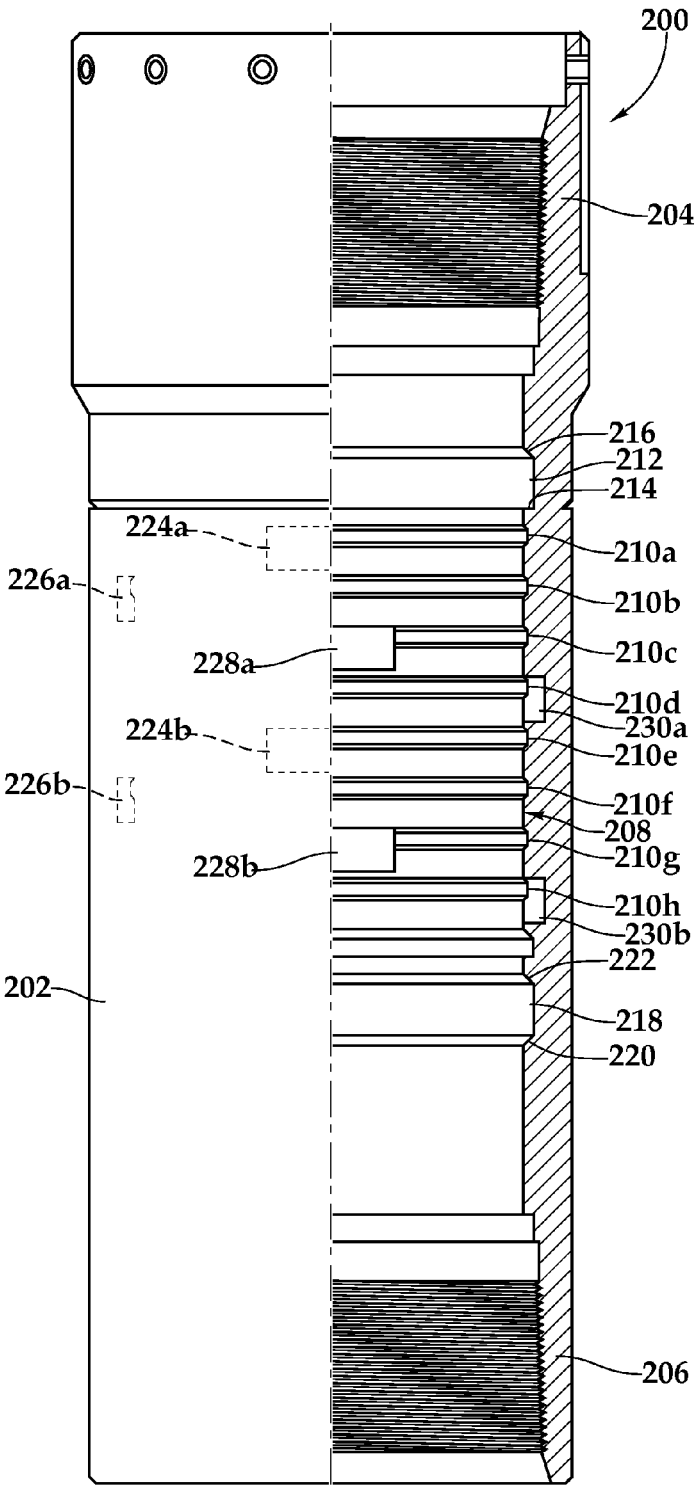
FIG. 7 is a quarter sectional view of a latch coupling for use with a hydraulic pressure intensifier operable to open a window in a casing string during multilateral wellbore construction according to an embodiment of the present invention.

Referring next to FIG. 7, one embodiment of a latch coupling operable for use with a hydraulic pressure intensifier for multilateral wellbore construction of the present invention is depicted and generally designated 200. Latch coupling 200 is representative of latch coupling 104 depicted above; however, as discussed above, each latch coupling will have a unique inner profile and preferential circumferential alignment elements that are different from that of other latch couplings to enable selective engagement with a matching or mating outer profile of the desired latch assembly. Accordingly, latch coupling 200 is described herein to illustrate the type of elements and combination of elements that can be used to create any number of unique profiles as contemplated by the present invention.

Latch coupling 200 has a generally tubular body 202 and may be coupled to other tools or tubulars such as liner string 42 via threaded connections 204, 206. Latch coupling 200 includes an internal profile 208 including a plurality of axially spaced apart recessed grooves 210*a*-210*h* that extend circumferentially about the inner surface of latch coupling 200. Preferably, recessed grooves 210*a*-210*h* extend about the entire circumferential internal surface of latch coupling 200. Internal profile 208 also includes an upper groove 212 having a lower square shoulder 214 and an upper angled shoulder 216. Internal profile 208 further includes a lower groove 218 having a lower angled shoulder 220 and an upper angled shoulder 222.

Internal profile 208 also has a plurality of preferential circumferential alignment elements depicted as a plurality of slots disposed within the inner surface of latch coupling 200. In the illustrated embodiment, there are four sets of two slots that are disposed in different axial and circumferential positions or locations within the inner surface of latch coupling 200. For example, a first set of two slots or recesses 224*a*, 224*b* (collectively recesses 224) are disposed within the inner surface of latch coupling 200 at substantially the same circumferential positions and different axial positions. A second set of two slots or recesses 226*a*, 226*b* (collectively recesses 226) are disposed within the inner surface of latch coupling 200 at substantially the same circumferential positions and different axial positions. A third set of two slots or recesses 228*a*, 228*b* (collectively recesses 228) are disposed within the inner surface of latch coupling 200 at substantially the same circumferential positions and different axial positions. A fourth set of two slots or recesses 230*a*, 230*b* (collectively recesses 230) are disposed within the inner surface of latch coupling 200 at substantially the same circumferential positions and different axial positions.

As shown, recesses 226 are disposed within the inner surface of latch coupling 200 at a ninety degree angle circumferentially from recesses 224. Likewise, recesses 228 are disposed within the inner surface of latch coupling 200 at a ninety degree angle circumferentially from recesses 226. Finally, recesses 230 are disposed within the inner surface of latch coupling 200 at a ninety degree angle circumferentially from recesses 228. Preferably, recesses 224, 226, 228, 230 only partially extend circumferentially about the internal surface of latch coupling 200.

Profile 208 including the preferential circumferential alignment elements creates a unique mating pattern operable to cooperate with an external key profile associated with a desired latch assembly to axially and circumferentially anchor and orient a window opening tool in a particular desired circumferential orientation relative to the window joint of the casing string. The specific profile of each latch coupling can be created by varying one or more of the elements or parameters thereof. For example, the thickness, number and relative spacing of the recessed grooves can be altered, the axial and circumferential spacing of the preferential circumferential alignment elements can be altered, the axial and circumferential thickness of the preferential circumferential alignment elements can be altered, the number of preferential circumferential alignment elements can be altered and the like.

Figure 8:
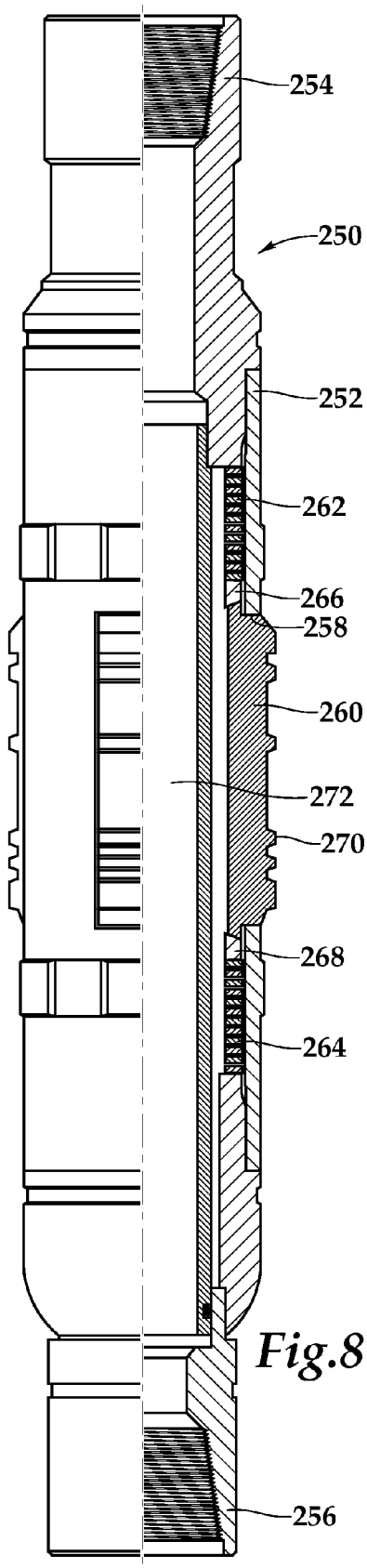
FIG. 8 is a quarter sectional view of a latch assembly for use with a hydraulic pressure intensifier operable to open a window in a casing string during multilateral wellbore construction according to an embodiment of the present invention.

Referring next to FIG. 8, an anchor assembly depicted as a latch assembly operable for use with a hydraulic pressure intensifier for multilateral wellbore construction of the present invention is depicted and generally designated 250. Latch assembly 250 includes a latch housing 252 may be coupled to other tools or tubulars such a hydraulic pressure intensifier via threaded connections 254, 256. Latch housing 252 has a plurality of elongated openings 258 formed therethrough. A plurality of spring operated keys 260 extend through elongated openings 258. Keys 260 are radially outwardly biased by Belleville springs 262, 264 that urge conical wedges 266, 268 under keys 260 from above and below. Alignment between keys 260 and openings 258 as well as appropriate spacing between keys 260 are maintained by latch housing 252, which also limits the outward displacement keys 260.

The anchoring and orienting functions of latch assembly 250 with a latch coupling having the appropriate mating profile are performed by engagement between external profiles 270 formed on each of the keys 260 and inner profile and preferential circumferential alignment elements formed in the latch coupling. Different profiles 270 are formed on keys 260 of latch assembly 250, to correspond to different radial portions of the inner profile and preferential circumferential alignment elements formed in the latch coupling. When latch assembly 250 is disposed within the corresponding latch coupling, profiles 270 on keys 260 initially engage the inner profile and thereby prevent further longitudinal displacement of latch assembly 250 relative to the latch coupling. Latch assembly 250 is then rotated within the latch coupling, until each of the profiles 270 engages the corresponding preferential circumferential alignment elements formed in the latch coupling, thereby preventing further rotational displacement of latch assembly 250 relative to the latch coupling. Latch assembly 250 includes a central bore 272 which allows fluids and other tools or tubulars such as drill pipe to pass therethrough.

Figure 9A:
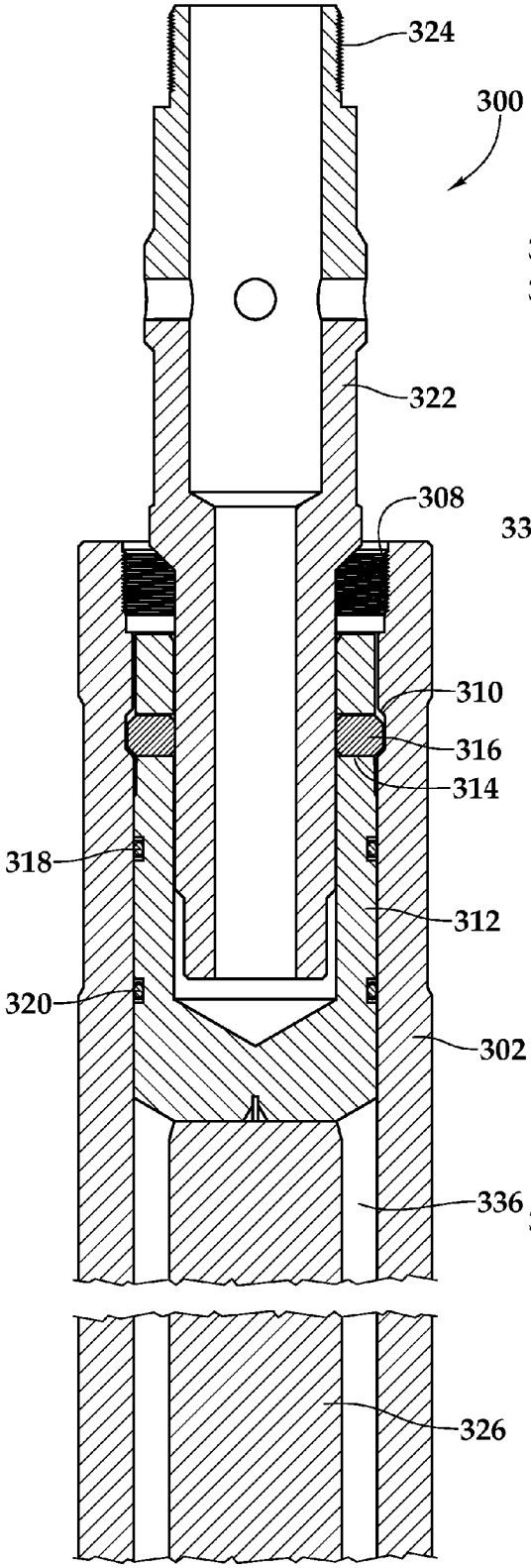
FIGS. 9A-9B are cross sectional views of a hydraulic pressure intensifier operable to open a window in a casing string during multilateral wellbore construction according to an embodiment of the present invention in a first operational configuration.
Figure 9B:
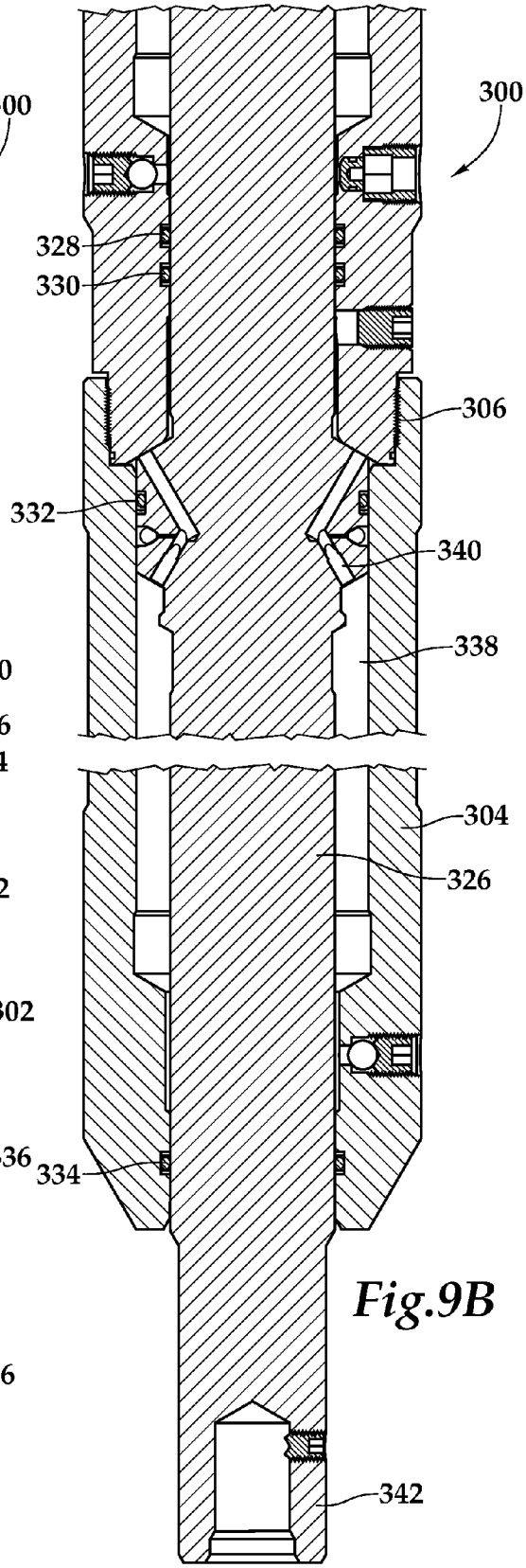

Referring next to FIGS. 9A-9B, consecutive axial sections of a hydraulic pressure intensifier for multilateral wellbore construction of the present invention are depicted and generally designated 300. Hydraulic pressure intensifier 300 includes an outer housing depicted as upper housing member 302 and lower housing member 304 that are threadedly and sealably coupled together at 306. Upper housing member 302 may be coupled to other tools or tubulars such a latch assembly via threaded connection 308. Upper housing member 302 has a radially reduced groove 310.

Slidably positioned within upper housing member 302 is a piston 312. Piston 312 includes a plurality of openings 314 in the sidewall portion thereof. A plurality of lugs 316 are positioned within openings 314. A pair of seals depicted as O-rings 318, 320 provides for a sealing engagement between piston 312 and the interior of upper housing member 302. Slidably positioned within piston 312 is a running tool 322. Running tool 322 may be coupled to other tools or tubulars such a drill string via threaded connection 324. As illustrated, running tool 322 props lugs 316 into groove 310 which initially prevents relative longitudinal movement between piston 312 and upper housing member 302. Preferably, running tool 322 is initially longitudinally secured relative to upper housing member 302 by, for example, a shear pin connection between running tool 322 or a tubular attached thereto and the latch assembly coupled to upper housing member 302.

Positioned below piston 302 is a piston 326. A pair of seals depicted as O-rings 328, 330 provides for a sealing engagement between piston 326 and the interior of upper housing member 302. A second pair of seals depicted as O-rings 332, 334 provides for a sealing engagement between piston 326 and the interior of lower housing member 304. Together, piston 312 and piston 326 may be referred to as a piston assembly. A low pressure or atmospheric chamber 336 is defined between piston 326 and the interior of upper housing member 302. Atmospheric chamber 336 preferably contains a compressible fluid such as nitrogen gas. An optional hydraulic chamber 338 is defined between piston 326 and the interior of lower housing member 304. Piston 326 includes a dampening assembly depicted as a plurality of jets 340 operable to control the rate of hydraulic fluid transfer therethrough in embodiments utilizing an operating fluid within hydraulic chamber 338. Additionally, at its lower end, piston 326 includes a connector 342 for coupling piston 326 to other tools such as one of the window opening tools discussed above.

Figure 10A:
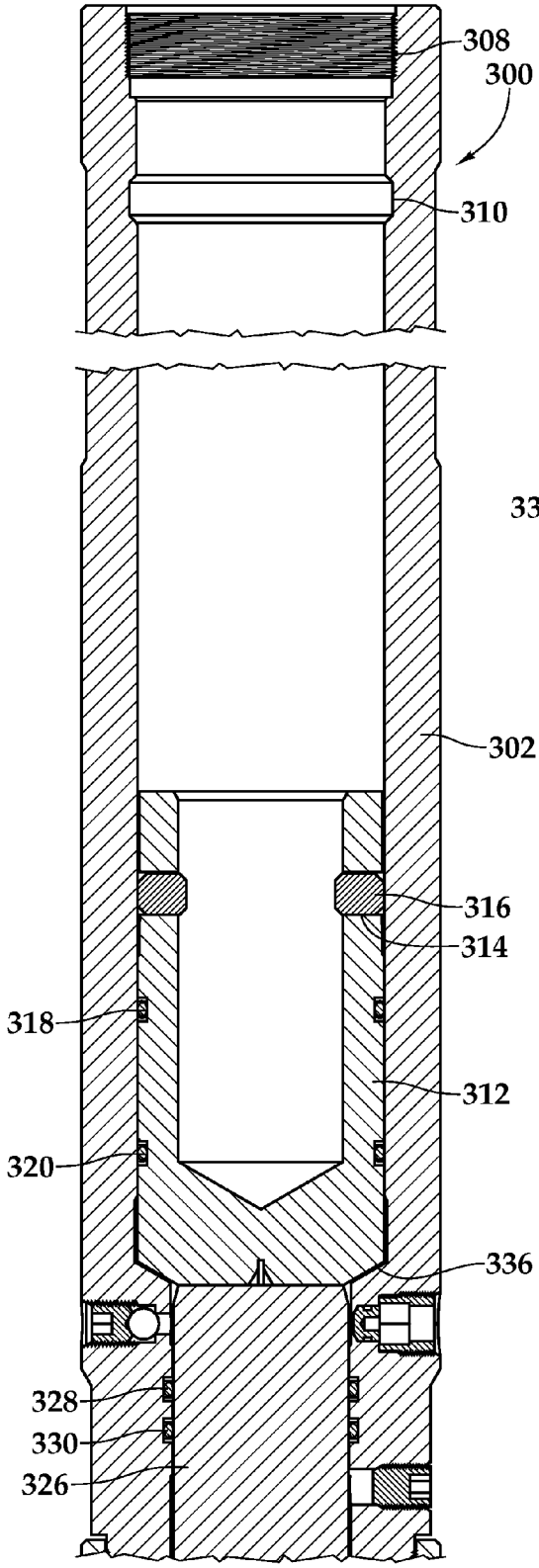
FIGS. 10A-10B are cross sectional views of a hydraulic pressure intensifier operable to open a window in a casing string during multilateral wellbore construction according to an embodiment of the present invention in a second operational configuration.
Figure 10B:
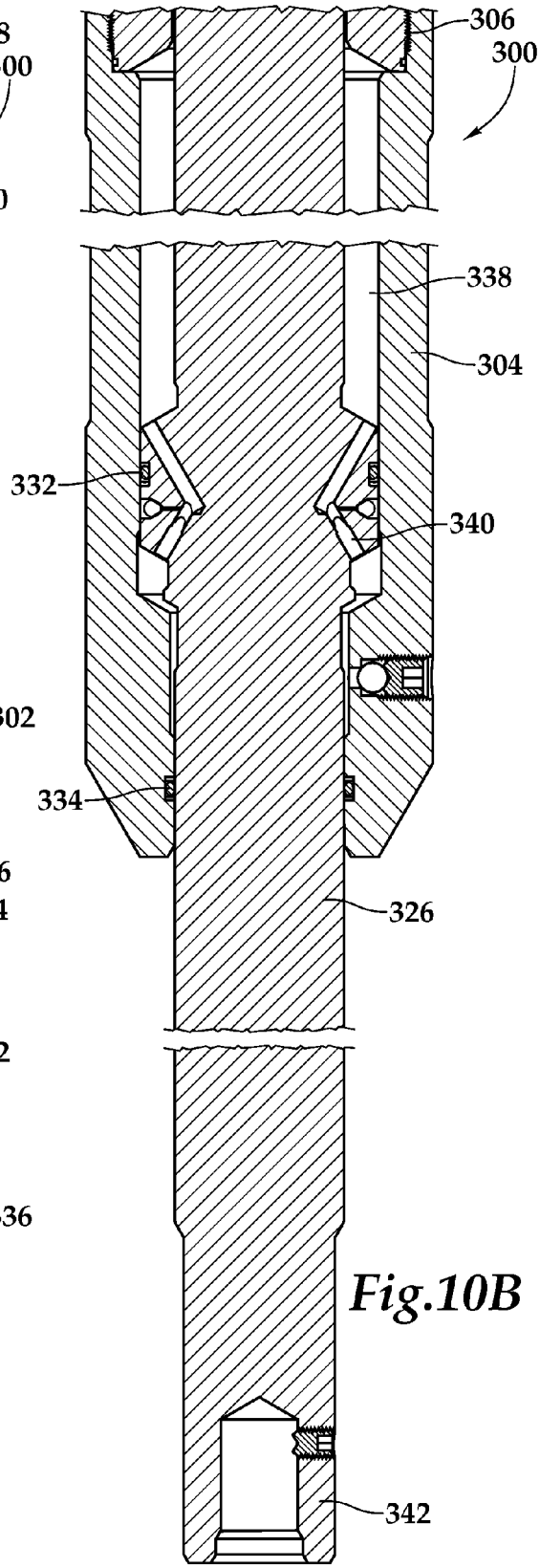

Preferably, hydraulic pressure intensifier 300 is operated using the hydrostatic pressure in the wellbore. Alternatively, the pressure in the wellbore can be enhanced by adding additional pressure at the surface. In either case, the operation of hydraulic pressure intensifier 300 is based upon the differential areas of piston 312 and piston 326. In one embodiment, piston 312 may have a diameter of approximately 8 inches and piston 326 may have a diameter of approximately 2 inches. The calculated surface area of piston 312 is approximately 50.26 $in^2$ and the calculated surface area of piston 326 is approximately 3.14 $in^2$. The difference between these two surface areas is approximately 47.12 $in^2$. In this example, if piston 312 and piston 326 are in a pressure environment of 5,000 pounds per square inch, this pressure acting on the differential areas of piston 312 and piston 326 creates a resultant force that can be exerted by piston 326 of approximately 235,650 pounds of force. This downward force is exerted by piston 326 when running tool 322 is shifted upwardly relative to piston 312 which unprops lugs 316 allowing piston 312 and piston 326 to move longitudinally downwardly relative to upper housing member 302 and lower housing member 304, as best seen in FIGS. 10A-10B. The speed of this movement can be regulated by forcing the optional operating fluid in hydraulic chamber 338 through jets 340. The downward movement and downward force of piston 326 operate on a window opening tool to create the desired window in a casing string.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A system for opening a window in a casing string positioned in a wellbore, the system comprising:

a hydraulic pressure intensifier having a housing and a piston assembly with a differential piston area, the piston assembly longitudinally shiftable relative to the housing, the piston assembly initially secured relative to the housing to prevent longitudinal movement therebetween;

an anchor assembly operably associated with the hydraulic pressure intensifier, the anchor assembly operable to longitudinally secure the hydraulic pressure intensifier within the casing string; and a window opening tool operably associated with the hydraulic pressure intensifier and operably engagable with the casing string such that when the anchor assembly is longitudinally secured within the casing string and the piston assembly is unsecured relative to the housing under hydrostatic pressure in the wellbore, longitudinal movement of the piston assembly transmits a force to the window opening tool, thereby opening the window in the casing string.

2. The system as recited in claim 1 wherein the casing string further comprises a main wellbore casing string.

3. The system as recited in claim 1 wherein the casing string further comprises a lateral wellbore casing string.

4. The system as recited in claim 1 wherein the piston assembly is initially secured relative to the housing via a plurality of lugs extending through openings of the piston assembly and radially propped in a groove of the housing.

5. The system as recited in claim 4 wherein the piston assembly is unsecured relative to the housing by longitudinally shifting a running tool to unprop the plurality of lugs.

6. The system as recited in claim 1 wherein the piston assembly further comprises a first piston having a first cross sectional area and a second piston operably associate with the first piston and having a second cross sectional area, the first cross sectional area being greater than the second cross sectional area.

7. The system as recited in claim 1 wherein the piston assembly further comprises a dampening assembly operable to control the velocity of the longitudinal movement of the piston assembly.

8. The system as recited in claim 7 wherein the dampening assembly is operable to control the rate of hydraulic fluid transfer therethrough.

9. The system as recited in claim 1 wherein the anchor assembly further comprises a latch assembly.

10. The system as recited in claim 1 wherein the window opening tool is selected from the group consisting of a cutting tool, a retrieval tool and a penetration tool.

11. A method for opening a window in a casing string positioned in a wellbore, the method comprising:

running a hydraulic pressure intensifier having a housing and a piston assembly with a differential piston area in the casing string, the piston assembly initially secured relative to the housing to prevent longitudinal movement therebetween;

positioning a window opening tool operably associated with the hydraulic pressure intensifier at a target location in the casing string;

longitudinally securing the hydraulic pressure intensifier within the casing string with an anchor assembly;

unsecuring the piston assembly relative to the housing under hydrostatic pressure in the wellbore; and longitudinally moving the piston assembly to transmit a force to the window opening tool, thereby opening the window in the casing string.

12. The method as recited in claim 11 wherein running a hydraulic pressure intensifier having a housing and a piston assembly with a differential piston area in the casing string further comprises running the hydraulic pressure intensifier into a main wellbore casing string.

13. The method as recited in claim 11 wherein running a hydraulic pressure intensifier having a housing and a piston assembly with a differential piston area in the casing string further comprises running the hydraulic pressure intensifier into a lateral wellbore casing string.

14. The method as recited in claim 11 further comprising radially propping a plurality of lugs extending through openings of the piston assembly in a groove of the housing to initially secure the piston assembly relative to the housing.

15. The method as recited in claim 14 wherein unsecuring the piston assembly relative to the housing under hydrostatic pressure in the wellbore further comprises longitudinally shifting a running tool to unprop the plurality of lugs.

16. The method as recited in claim 11 wherein the piston assembly further comprises a first piston having a first cross sectional area and a second piston operably associate with the first piston and having a second cross sectional area, the first cross sectional area being greater than the second cross sectional area.

17. The method as recited in claim 11 further comprising controlling the velocity of the longitudinal movement of the piston assembly with a dampening assembly of the piston assembly.

18. The method as recited in claim 17 wherein controlling the velocity of the longitudinal movement of the piston assembly with a dampening assembly further comprises controlling the rate of hydraulic fluid transfer through the damping assembly.

19. The method as recited in claim 11 wherein longitudinally securing the hydraulic pressure intensifier within the casing string with anchor assembly further comprises engaging a latch assembly with a latch coupling of the casing string.

20. The method as recited in claim 11 wherein opening the window in the casing string further comprises cutting the window in the casing string.

21. The method as recited in claim 11 wherein opening the window in the casing string further comprises removing a window insert from the casing string.

22. The method as recited in claim 11 wherein opening the window in the casing string further comprises penetrating the casing string to open a pre-cut window in the casing string.

* * * * *